US010370209B2

(12) United States Patent
Hattori

(10) Patent No.: US 10,370,209 B2
(45) Date of Patent: Aug. 6, 2019

(54) RECORDING MEDIUM PROCESSING DEVICE AND IMAGE FORMING APPARATUS

(71) Applicant: FUJI XEROX CO., LTD., Tokyo (JP)

(72) Inventor: Ryuji Hattori, Yokohama (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 44 days.

(21) Appl. No.: 15/640,648

(22) Filed: Jul. 3, 2017

(65) Prior Publication Data

US 2018/0273320 A1 Sep. 27, 2018

(30) Foreign Application Priority Data

Mar. 24, 2017 (JP) ..... 2017-058562

(51) Int. Cl.

| | |
|---|---|
| ***B65H 5/36*** | (2006.01) |
| ***B65H 5/06*** | (2006.01) |
| ***G03G 15/00*** | (2006.01) |
| ***G03G 15/20*** | (2006.01) |

(52) U.S. Cl.

CPC ..... *B65H 5/36* (2013.01); *B65H 5/062* (2013.01); *B65H 5/068* (2013.01); *G03G 15/2028* (2013.01); *G03G 15/6529* (2013.01); *G03G 15/6532* (2013.01); *B65H 2402/31* (2013.01); *B65H 2404/144* (2013.01);

(Continued)

(58) Field of Classification Search

CPC ..... B65H 5/06; B65H 5/062; B65H 5/068; B65H 5/36; B65H 5/38; B65H 2402/31; B65H 2404/144; B65H 2404/1441; B65H 2404/60; B65H 2404/61; B65H 2404/63; B65H 2404/633; B65H 2404/65; G03G 15/2028; G03G 15/6532; G03G 2215/00573

USPC ..... 399/316, 322, 323, 398, 399

See application file for complete search history.

(56) References Cited

U.S. PATENT DOCUMENTS 3,955,889 A * 5/1976 Ishiguro ..... G03G 15/6532 399/399
4,583,726 A * 4/1986 Nogi ..... B65H 3/5284 271/119

(Continued)

FOREIGN PATENT DOCUMENTS

JP 60017776 A * 1/1985 ..... G03G 15/6532
JP 2002-023506 A 1/2002

*Primary Examiner* — Prasad V Gokhale

(74) *Attorney, Agent, or Firm* — Sughrue Mion, PLLC

(57) ABSTRACT

A recording medium processing device includes: a pair of contacting members including a first contacting member and a second contacting member, the first contacting member and the second contacting member contacting each other at a contact portion and contacting a recording medium passing through the contact portion, a contact position of the second contacting member on the first contacting member changing in response to displacement of the second contacting member with respect to the first contacting member in a state of being held in a position for recording medium transportation; and a guide member mounted to the second contacting member, the guide member guiding the recording medium having passed through the contact portion at which the first contacting member and the second contacting member contact each other.

8 Claims, 4 Drawing Sheets

(52) U.S. Cl.
CPC .... *B65H 2404/633* (2013.01); *B65H 2404/65* (2013.01); *G03G 2215/00573* (2013.01)

(56) References Cited

U.S. PATENT DOCUMENTS

| | | | | |
|---|---|---|---|---|
| 5,762,332 | A * | 6/1998 | Haroutel | B65H 5/062 198/624 |
| 9,463,941 | B2 * | 10/2016 | Mori | B65H 7/02 |
| 2012/0119437 | A1 * | 5/2012 | Koike | B65H 5/062 271/264 |
| 2012/0326384 | A1 * | 12/2012 | Arikata | B65H 29/006 271/184 |
| 2014/0091518 | A1 * | 4/2014 | Nishii | B65H 29/14 271/274 |
| 2015/0035227 | A1 * | 2/2015 | Nakamura | B65H 5/062 271/246 |
| 2016/0255211 | A1 * | 9/2016 | Kawabata | H04N 1/0032 358/1.14 |
| 2017/0008713 | A1 * | 1/2017 | Yamaguchi | G03G 15/6529 |

* cited by examiner

RECORDING MEDIUM PROCESSING DEVICE AND IMAGE FORMING APPARATUS

CROSS REFERENCE TO RELATED APPLICATIONS

This application is based on and claims priority under 35 USC § 119 from Japanese Patent Application No. 2017-058562 filed Mar. 24, 2017.

BACKGROUND

Technical Field

The present invention relates to a recording medium processing device and an image forming apparatus.

Related Art

Conventionally, some apparatuses with a unit for transporting a recording medium include a guide member that guides the recording medium being transported.

SUMMARY

According to an aspect of the present invention, there is provided a recording medium processing device including: a pair of contacting members including a first contacting member and a second contacting member, the first contacting member and the second contacting member contacting each other at a contact portion and contacting a recording medium passing through the contact portion, a contact position of the second contacting member on the first contacting member changing in response to displacement of the second contacting member with respect to the first contacting member in a state of being held in a position for recording medium transportation; and a guide member mounted to the second contacting member, the guide member guiding the recording medium having passed through the contact portion at which the first contacting member and the second contacting member contact each other.

BRIEF DESCRIPTION OF THE DRAWINGS

An exemplary embodiment of the present invention will be described in detail based on the following figures, wherein.

DETAILED DESCRIPTION

Hereinafter, the exemplary embodiments will be described in detail with reference to attached drawings.

Figure 1:
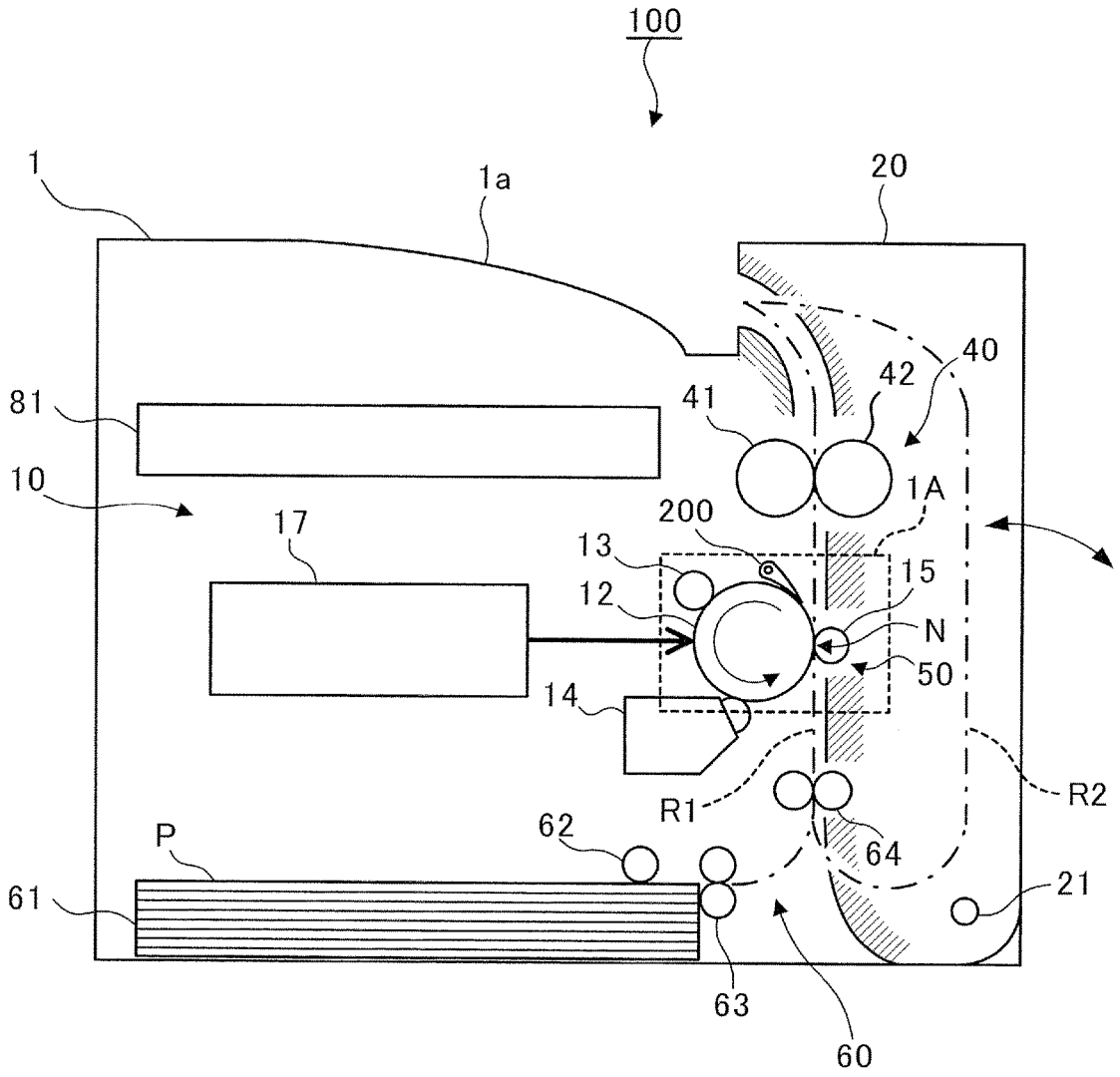
FIG. 1 illustrates an entire configuration of an image forming apparatus to which the exemplary embodiment is applied.

FIG. 1 illustrates an entire configuration of an image forming apparatus 100 to which the exemplary embodiment is applied.

The image forming apparatus 100 includes an apparatus main body 1. Inside the apparatus main body 1, an image forming unit 10 is provided that forms an image on a sheet P, which is an example of a recording medium.

Further, a sheet transport mechanism 60 and a controlling device 81 are provided inside the apparatus main body 1. The sheet transport mechanism 60 transports the sheet P. The control device 81 controls operations of each device (each unit).

The sheet transport mechanism 60 transports the sheet P by moving the sheet P along a predetermined sheet transport path R1 (a recording medium transport path).

In the exemplary embodiment, a toner image is formed and fixed on the sheet P while the sheet P is passing along the sheet transport path R1. Further, in the exemplary embodiment, a reverse transport path R2 is provided for reversing the sheet P and feeding it again into a transfer portion 50 (details described later).

Additionally, inside the apparatus main body 1, a fixing device 40 is provided that fixes, onto the sheet P, the toner image having been formed on the sheet P by the image forming unit 10.

Also, in the exemplary embodiment, a cover 20, which is an example of a covering member, is provided so as to be opened from and closed against the apparatus main body 1. The cover 20 is opened and closed around a hinge 21 located at the lower right in the figure.

Here, each of the portions where the transfer portion 50, the fixing device 40 and the like are provided can be regarded as a recording medium processing device that performs processing on the sheet P, which is a recording medium.

In the exemplary embodiment, to replace a part or to deal with sheet jamming, the cover 20 is rotated clockwise in the figure around the hinge 21 to be opened. This results in the sheet transport path R1 being uncovered.

In the exemplary embodiment, a transfer roll 15 (described later) and a pressure roll 42 (described later) are mounted to the cover 20. Accordingly, when the cover 20 is opened, the transfer roll 15 and the pressure roll 42 also move in conjunction with the cover 20.

The image forming unit 10 is provided with a photoconductive drum 12. The photoconductive drum 12, which is an example of the first contacting member, contacts one surface of the sheet P transported from below and transfers the toner image held by the photoconductive drum 12 onto the one surface.

Further, the image forming unit 10 is provided with a charging device 13 that charges the photoconductive drum 12. The image forming unit 10 is also provided with an exposure device 17. The exposure device 17 irradiates with light the photoconductive drum 12 charged by the charging device 13 to form an electrostatic latent image on the photoconductive drum 12. The image forming unit 10 is further provided with a developing device 14 that develops the electrostatic latent image formed on the photoconductive drum 12 to form the toner image.

The image forming unit 10 is further provided with the transfer portion 50 at which the toner image formed on the photoconductive drum 12 is transferred onto the sheet P.

The transfer portion 50 is provided with the transfer roll 15, which is an example of the second contacting member. When the sheet P is transported from below toward the transfer portion 50, the transfer roll 15 contacts the other surface of the sheet P. That is to say, in the exemplary embodiment, when the sheet P is transported from below toward the transfer portion 50, the photoconductive drum 12 contacts the one surface of the sheet P while the transfer roll 15 contacts the other surface of the sheet P.

In the transfer portion 50, a charge is applied between the transfer roll 15 and the photoconductive drum 12, which causes the toner image on the photoconductive drum 12 to be transferred onto the sheet P.

The transfer roll 15 is arranged so as to face the photoconductive drum 12 across the sheet transport path R1 (the recording medium transport path) and to be in contact with the photoconductive drum 12.

The transfer roll 15 is mounted to the cover 20 side and moves in conjunction with the cover 20. Note that the photoconductive drum 12 is supported in the apparatus main body 1 side and remains within the apparatus main body 1 side when the cover 20 is opened.

The transfer roll 15 contacts the other surface of the sheet P when the sheet P passes through a contact portion N where the photoconductive drum 12 and the transfer roll 15 contact each other.

More specifically, when the sheet P passes through the contact portion N, the photoconductive drum 12 contacts the one surface of the sheet P on which an image is to be formed. Meanwhile, the transfer roll 15 contacts the other surface (the surface on which an image is not to be formed in simplex printing) of the sheet P opposite to the one surface.

In other words, in the exemplary embodiment, the photoconductive drum 12 and the transfer roll 15, which are a pair of contacting members, are provided, and the photoconductive drum 12 constituting one of the pair of the contacting members contacts the image forming surface of the sheet P. Meanwhile, the transfer roll 15, which is the other of the pair of the contacting members, contacts the surface of the sheet P opposite to the image forming surface.

At the downstream side of the contact portion N in the transport direction of the sheet P, a guide member 200 is provided that guides the sheet P having passed through the contact portion N.

The guide member 200 is mounted to the cover 20 side (details described later). The guide member 200 is arranged in contact with the surface of the photoconductive drum 12 and guides the sheet P toward the fixing device 40 after peeling the sheet P stuck to the surface of the photoconductive drum 12.

The sheet P may be stuck to the photoconductive drum 12 due to adhesion of the toner image on the sheet P to the photoconductive drum 12. The guide member 200 enters between the sheet P and the surface of the photoconductive drum 12 to peel the sheet P from the surface of the photoconductive drum 12, and then guides it toward the fixing device 40.

Although the explanation is given using the case where the guide member 200 contacts the photoconductive drum 12 in the exemplary embodiment, the guide member 200 may be provided away from the photoconductive drum 12. In such a case, the guide member 200 does not have the peeling function, and has the guiding function of the sheet P alone.

The fixing device 40 is provided with a fixing roll 41 and a pressure roll 42. The fixing roll 41 includes a heating source (not shown in the figure). The pressure roll 42 is arranged in pressure contact with the fixing roll 41.

In the exemplary embodiment, when the sheet P with the toner image formed thereon reaches the fixing device 40, the sheet P is sandwiched by the fixing roll 41 and the pressure roll 42 to be pressured and heated. This causes the toner image on the sheet P to be fixed onto the sheet P.

The sheet transport mechanism 60 includes a sheet stacking portion 61, a feed roll 62, and a transport roll 63. The sheet stacking portion 61 is for stacking the sheets P. The feed roll 62 feeds the sheets P stacked on the sheet stacking portion 61. The transport roll 63 separates the sheets P fed from the feed roll 62 and transports each sheet P individually.

The sheet transport mechanism 60 further includes a transport roll 64 that transports each of the sheets P separated by the transport roll 63 toward the transfer portion 50.

A series of operations of the image forming apparatus 100 will be explained.

At the start of an image forming operation, the feed roll 62, the transport roll 63 and the transport roll 64 rotate first to initiate transportation of the sheet P.

Specifically, the feed roll 62 feeds the sheet P from the sheet stacking portion 61, and the sheet P is transported further to the downstream side by the transport roll 63 and the transport roll 64.

Meanwhile, in the image forming unit 10, the exposure device 17 scans and exposes the surface of the photoconductive drum 12 having been charged by the charging device 13, to form an electrostatic latent image on the surface of the photoconductive drum 12. The formed electrostatic latent image is developed by the developing device 14 as a toner image. Thus, the toner image is formed on the surface of the photoconductive drum 12.

The toner image formed on the surface of the photoconductive drum 12 is then transferred at the transfer portion 50 onto the sheet P having been transported by the transport roll 64.

The sheet P holding the transferred toner image is transported to the fixing device 40, by which the sheet P is pressured and heated. Thereafter, the sheet P is output to an exit portion 1*a* provided on the upper part of the image forming apparatus 100.

Figure 2:
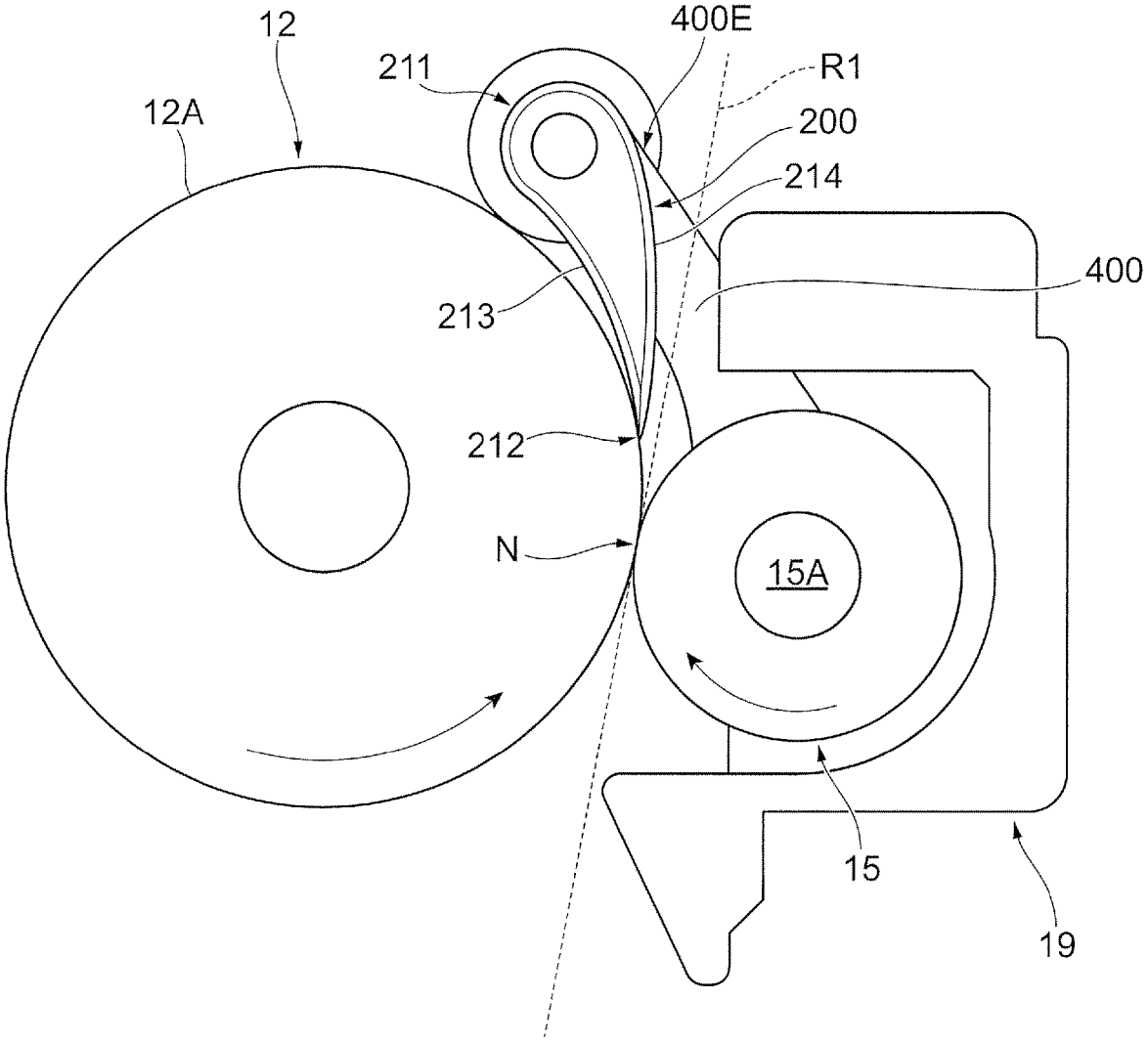
FIG. 2 is an enlarged view of a part indicated by 1A in FIG. 1.

FIG. 2 is an enlarged view of a part indicated by 1A in FIG. 1.

As explained above, in the exemplary embodiment, the guide member 200 is provided on the downstream side of the contact portion N in the transport direction of the sheet P to guide the sheet P having passed through the contact portion N.

As shown in FIG. 2, the guide member 200 is arranged in contact with the surface (outer circumferential surface) 12A of the photoconductive drum 12. The guide member 200 guides the sheet P toward the downstream side after peeling the sheet P stuck to the surface 12A of the photoconductive drum 12.

The guide member 200 is arranged along the surface 12A of the photoconductive drum 12. The guide member 200 includes a downstream side end 211 on the downstream side in the rotational direction of the photoconductive drum 12, and an upstream side end 212 on the upstream side in the rotational direction of the photoconductive drum 12.

Also, the guide member 200 is formed such that its width (width in the radial direction of the photoconductive drum 12) gradually decreases from the downstream side end 211 toward the upstream side end 212.

Further, the guide member 200 is arranged with the upstream side end 212 being in contact with the photoconductive drum 12. Also, the guide member 200 is arranged such that the guide member 200 is gradually away from the photoconductive drum 12 from the upstream side end 212 toward the downstream side end 211.

Additionally, the guide member 200 includes a facing surface 213 facing the photoconductive drum 12, and an opposite surface 214 opposite to the facing surface 213. The facing surface 213 is curved toward the opposite surface 214 side.

Further, the guide member 200 extends from the downstream side toward the upstream side in the rotational direction of the photoconductive drum 12, and extends just before reaching the contact portion N.

In the exemplary embodiment, the upstream side end 212 of the guide member 200 enters between the surface 12A of the photoconductive drum 12 and the sheet P having passed through the contact portion N and stuck to the surface 12A. This causes the sheet P to be peeled from the photoconductive drum 12.

After that, the sheet P is guided by the opposite surface 214 of the guide member 200 and directed toward the fixing device 40 (see FIG. 1).

Further, in the exemplary embodiment, a rotating member 400 is provided. The rotating member 400 is mounted to a rotary shaft 15A of the transfer roll 15 and rotates around the rotary shaft 15A.

The transfer roll 15 is a member rotating around the rotary shaft 15A, and the rotating member 400 is mounted to this rotary shaft 15A in the exemplary embodiment. In other words, in the exemplary embodiment, the rotating member 400 is mounted to the rotary shaft 15A such that the rotating member 400 is rotatable (swingable) around the rotary shaft 15A.

Further, in the exemplary embodiment, the guide member 200 is mounted to one end 400E (an end opposite to the end on the rotary shaft 15A side) of the rotating member 400.

In the exemplary embodiment, the guide member 200 is mounted to the rotating member 400 and, via this rotating member 400, to the rotary shaft 15A of the transfer roll 15.

The way for mounting the guide member 200 to the transfer roll 15 is not limited to directly mounting the guide member 200 to the transfer roll 15. The guide member 200 may be mounted to the transfer roll 15 via a member other than the transfer roll 15 as explained above.

In the exemplary embodiment, the photoconductive drum 12 and the transfer roll 15 are configured by separate members, and thus the transfer roll 15 may be displaced with respect to the photoconductive drum 12.

More specifically, in the exemplary embodiment, the photoconductive drum 12, on which the toner image is formed, is positioned with high accuracy so that the photoconductive drum 12 is less likely to be displaced. On the other hand, the transfer roll 15 is positioned with less accuracy than the photoconductive drum 12.

In this case, the transfer roll 15 is more likely to move compared to the photoconductive drum 12, which may cause the displacement of the transfer roll 15 with respect to the photoconductive drum 12.

Additionally, in the exemplary embodiment, the transfer roll 15 is mounted to the cover 20 (see FIG. 1) side. Accordingly, opening or closing of the cover 20 may cause the displacement of the transfer roll 15 with respect to the photoconductive drum 12.

In such a case, if the guide member 200 is not fixed to the transfer roll 15 but to the photoconductive drum 12 or any other member provided on the apparatus main body 1 side, the displacement of the transfer roll 15 may cause the transfer roll 15 to approach and contact the guide member 200.

Moreover, the displacement of the transfer roll 15 may also change the position of the contact portion N accordingly, which results in a change in the positional relationship between the contact portion N and the guide member 200. This may change the guiding direction of the guide member 200 for the sheet P, and the sheet P may be directed in a direction different from an intended direction.

That is to say, in the exemplary embodiment, the photoconductive drum 12 is positioned with high accuracy and held in a position for sheet transportation (image formation). On the other hand, the transfer roll 15 is likely to be displaced. In this case, the transfer roll 15 may be displaced with respect to the photoconductive drum 12 in the state of being held in the position for sheet transportation, and thus a contact position of the transfer roll 15 on the photoconductive drum 12 is likely to change.

In this case, the positional relationship between the contact position of the transfer roll 15 on the photoconductive drum 12 and the guide member 200 may change, and this may result in the guide member 200 guiding the sheet P in a direction different from the intended direction.

In contrast, in the exemplary embodiment, the guide member 200 is mounted to the transfer roll 15 and moves in conjunction with the transfer roll 15 even if the transfer roll 15 is displaced. With this configuration, the positional relationship between the contact portion N and the guide member 200 is less likely to change. In other words, the positional relationship between the contact position of the transfer roll 15 on the photoconductive drum 12 and the guide member 200 is less likely to change.

In the exemplary embodiment, the guide member 200 is mounted to the transfer roll 15, which is the contacting member contacting the sheet P. However, this expression "mounted to the contacting member" not only indicates a mode where the guide member 200 is mounted to the contacting member itself, but also indicates a mode where the guide member 200 is mounted to a member that is mounted to the contacting member.

More specifically, if the contacting member is a cylindrical rotation body such as the transfer roll 15 in the exemplary embodiment, the expression "mounted to the contacting member" not only indicates a mode where the guide member 200 is mounted to a part constituting the rotation body itself such as the rotary shaft of the rotation body, but also indicates a mode where the guide member 200 is mounted to a member that is mounted to the rotation body, such as a bearing mounted to the rotary shaft.

Further, the contacting member is not limited to the rotation body; the contacting member may include a fixing member that does not rotate such as a pad-shaped member. In this case, the expression "mounted to the contacting member" not only indicates a mode where the guide member 200 is mounted to the fixing member itself, but also indicates a mode where the guide member 200 is mounted to a member that is mounted to the fixing member, such as a holder for supporting the fixing member (a holder for supporting the pad-shaped member).

Figure 3B:
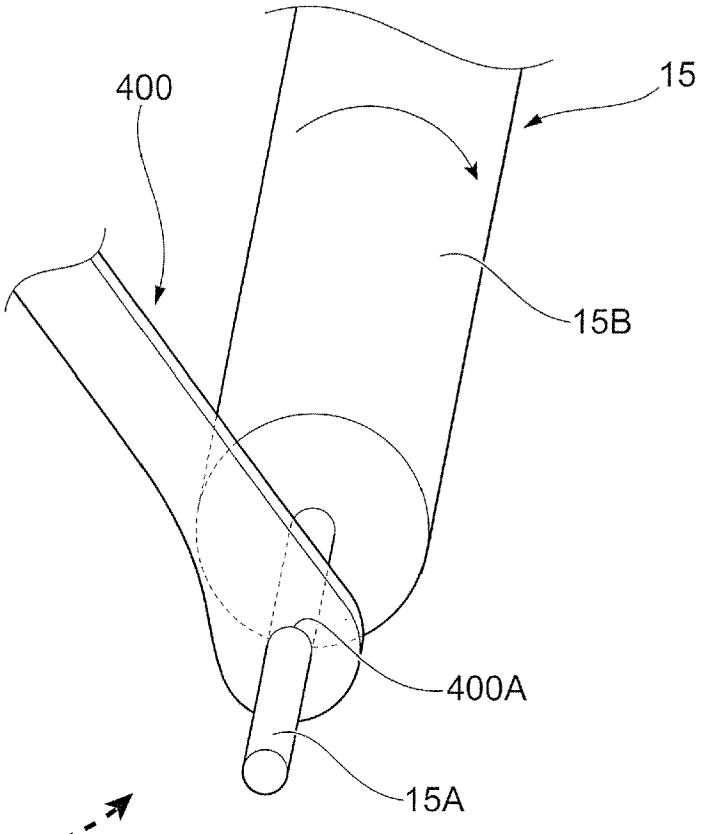
FIGS. 3A and 3B are perspective views of a photoconductive drum, a guide member and the like when viewed from obliquely above.
Figure 3A:
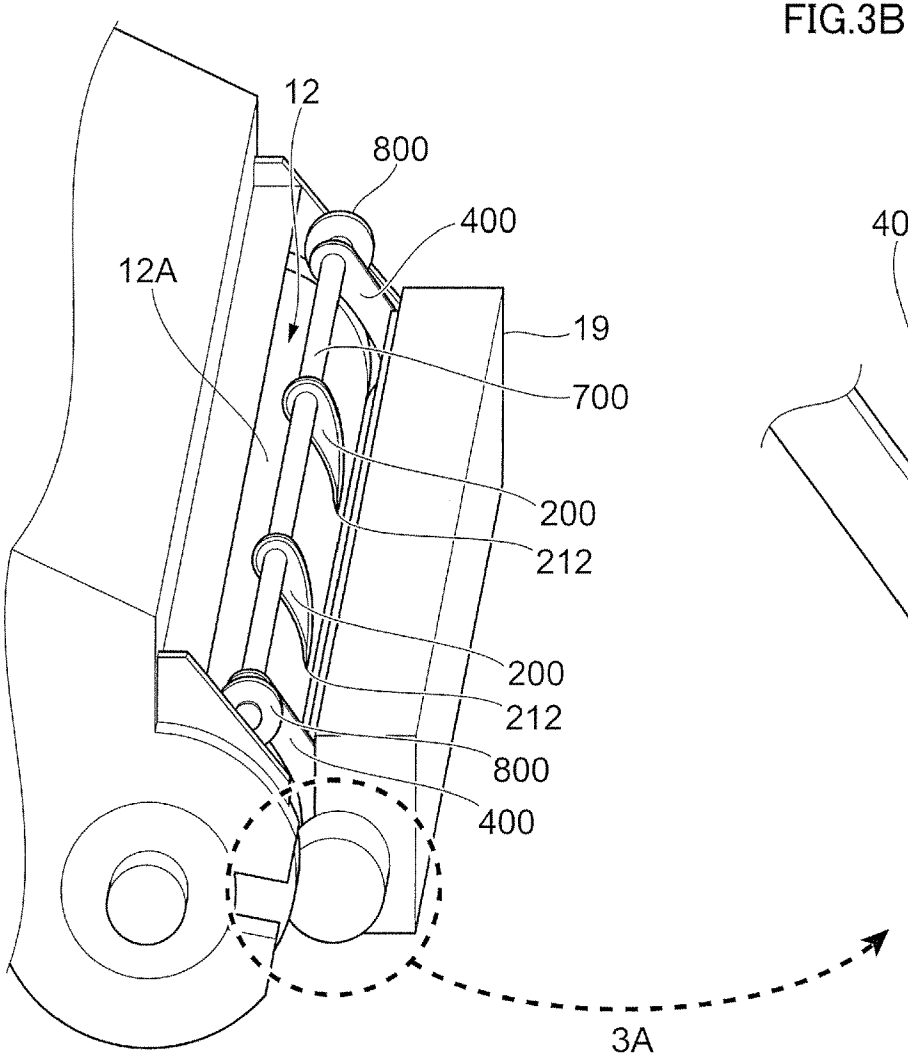

FIGS. 3A and 3B are perspective views of the photoconductive drum 12, the guide member 200 and the like when viewed from obliquely above. Note that the part indicated by 3A illustrates an end portion of the transfer roll 15 and the rotating member 400, which are hidden inside an accommodation housing 19.

As shown in the part indicated by 3A, the transfer roll 15 includes the rotary shaft 15A and rotates around this rotary shaft 15A. More specifically, the transfer roll 15 includes the columnar rotary shaft 15A and rotates around this rotary shaft 15A. The transfer roll 15 also includes a cylindrical member 15B arranged around the rotary shaft 15A. In the exemplary embodiment, an outer circumferential surface of the cylindrical member 15B contacts the surface 12A of the photoconductive drum 12.

As shown in the part indicated by 3A, the rotating member 400 includes a through hole 400A. In the exemplary embodiment, the rotary shaft 15A of the transfer roll 15 is inserted into this through hole 400A. The rotating member 400 moves (slides) around the rotary shaft 15A, which serves as a rotational center.

In the exemplary embodiment, two rotating members 400 are provided respectively corresponding to one end and the other end of the transfer roll 15 in the axial direction thereof.

Additionally, in the exemplary embodiment, a columnar connecting member 700 is provided that connects the two rotating members 400. The guide member 200 is mounted to this connecting member 700.

Further, multiple guide members 200 (two in the exemplary embodiment) are provided. The multiple guide members 200 are arranged such that their positions in a longitudinal direction of the connecting member 700 (positions in the axial direction of the photoconductive drum 12) are different from each other.

On both ends of the connecting member 700 in an axial direction thereof, a disk-shaped contacting member 800 is provided that contacts an end portion of the photoconductive drum 12 in the axial direction thereof.

The contacting member 800 contacts a portion where no toner image is formed, within the surface 12A of the photoconductive drum 12. Also, the contacting member 800 is arranged coaxially with the connecting member 700 and rotatable with respect to the connecting member 700.

The guide member 200 is mounted to the rotary shaft 15A of the transfer roll 15 via the connecting member 700 and the rotating member 400. This configuration allows the guide member 200 to move along the circumferential direction of the transfer roll 15 and around the rotary shaft 15A of the transfer roll 15.

If the guide member 200 moves around the rotary shaft 15A of the transfer roll 15, a distance between the guide member 200 and the outer circumferential surface of the transfer roll 15 may be maintained.

Further, in the exemplary embodiment, the rotating member 400 is pressed against the photoconductive drum 12 via the contacting member 800, and thus positioned with respect to the photoconductive drum 12. As a result, the guide member 200 is placed in a predetermined positional relationship with the photoconductive drum 12.

Here, a change in the position of the rotating member 400 with respect to the photoconductive drum 12 may result in, for example: the guide member 200 being strongly pressed against the photoconductive drum 12; or, conversely, the guide member 200 being lifted away from the photoconductive drum 12, which may decrease the peelability of the sheet P.

In contrast, in the exemplary embodiment, the rotating member 400 is pressed against the photoconductive drum 12, making the positions of the rotating member 400 and the guide member 200 less likely to change with respect to the photoconductive drum 12.

Further, in the exemplary embodiment, the guide member 200 is mounted to the rotating member 400 such that the posture of the guide member 200 with respect to the rotating member 400 may be changed.

Specifically, in the exemplary embodiment, the guide member 200 is rotatably mounted to the connecting member 700, and this allows to change the posture of the guide member 200 with respect to the rotating member 400.

This configuration allows to maintain the contact between the surface 12A of the photoconductive drum 12 and the guide member 200, as compared to the configuration that does not allow the change of the posture of the guide member 200. Further, the guide member 200 is less likely to be strongly pressed against the photoconductive drum 12.

Here, a change in the position of the rotating member 400 with respect to the photoconductive drum 12 may result in the guide member 200 being away from the photoconductive drum 12.

In contrast, if the posture of the guide member 200 with respect to the rotating member 400 may be changed as in the exemplary embodiment, the positional relationship of the guide member 200 with respect to the photoconductive drum 12 may be maintained despite the change in the position of the rotating member 400. This enables the guide member 200 to follow the surface 12A of the photoconductive drum 12.

Further, in the exemplary embodiment, the guide member 200 is pressed against the surface 12A of the photoconductive drum 12 using its own weight. In other words, the guide member 200 is pressed against the surface 12A of the photoconductive drum 12 using the gravity on the guide member 200.

Specifically, in the exemplary embodiment, the upstream side end 212 of the guide member 200 hangs down by gravity, and the guide member 200 is pressed against the photoconductive drum 12 using this hanging down of the upstream side end 212.

This configuration enables to prevent damage on the surface 12A of the photoconductive drum 12 and to reduce the number of parts, as compared to the configuration that uses a forcing member such as a spring to press the guide member 200 against the photoconductive drum 12.

Note that, in the exemplary embodiment, the rotating member 400 is also pressed against the photoconductive drum 12 using its own weight. In other words, the rotating member 400 is pressed against the photoconductive drum 12 using the gravity on the rotating member 400.

Note that the exemplary embodiment does not exclude the use of a forcing member to press the guide member 200 or the rotating member 400. If the guide member 200 or the rotating member 400 is located below the photoconductive drum 12, the forcing member may be used to press the guide member 200 or the rotating member 400 against the photoconductive drum 12.

Another Configuration Example

Figure 4:
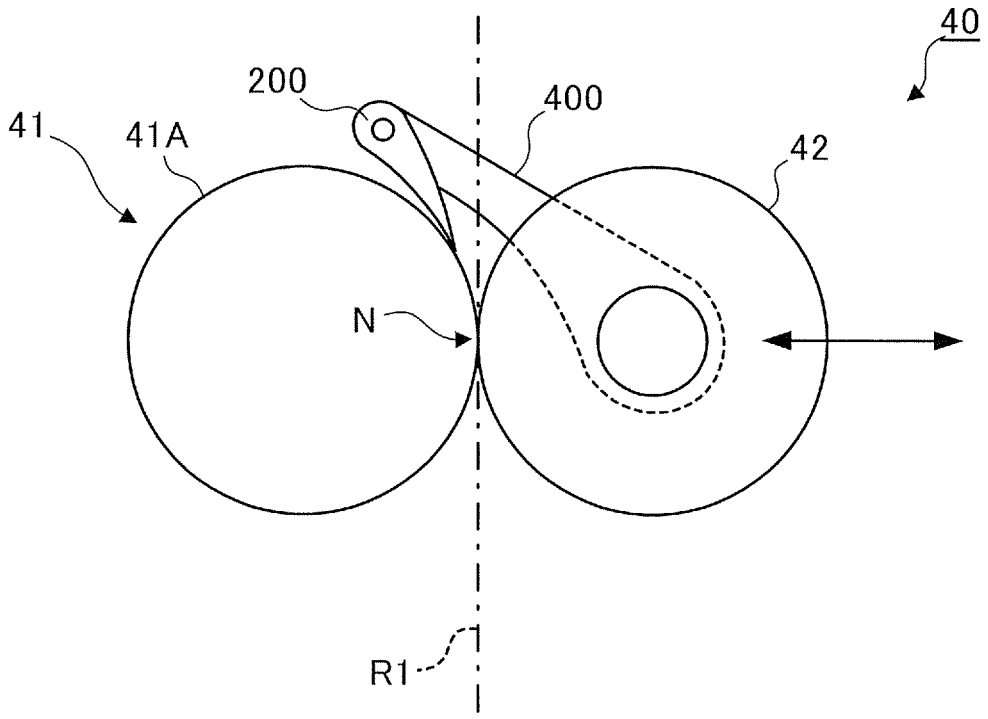
FIG. 4 illustrates a configuration example in which the guide member is provided to a fixing device.

FIG. 4 illustrates a configuration example in which the guide member 200 is provided to the fixing device 40.

The above explanation has been given using an example in which the guide member 200 is provided in the transfer portion 50. However, the place to provide the guide member 200 is not limited to the transfer portion 50. For example, the guide member 200 may be provided to the fixing device 40.

Specifically, in the configuration example shown in FIG. 4, the guide member 200 is provided on the downstream side of the contact portion N where the fixing roll 41 and the pressure roll 42 contact each other. The guide member 200 is brought into contact with a surface 41A of the fixing roll 41 and further mounted to the pressure roll 42 side.

In this fixing device 40, the pressure roll 42 is movable toward and away from the fixing roll 41. The pressure roll 42 moves away from the fixing roll 41 when a predetermined condition is satisfied, such as when the power is turned off or a power saving mode is activated. In other words, in the fixing device 40, the pressure roll 42 moves toward and away from the fixing roll 41.

In this configuration too, mounting the guide member 200 to the pressure roll 42, which moves forward and backward, enables to prevent the sheet P having passed through the contacting portion N from being guided in a direction different from the intended direction, similarly to the above.

The foregoing description of the present exemplary embodiments of the present invention has been provided for the purposes of illustration and description. It is not intended to be exhaustive or to limit the invention to the precise forms disclosed. Obviously, many modifications and variations will be apparent to practitioners skilled in the art. The present exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium processing device comprising:

a pair of contacting members including a first contacting member and a second contacting member, the first contacting member and the second contacting member being configured to contact each other at a contact portion and to contact a recording medium passing through the contact portion, a contact position of the second contacting member on the first contacting member being configured to change in response to displacement of the second contacting member with respect to the first contacting member in a state of being held in a position for recording medium transportation; and a guide member mounted to the second contacting member and configured to rotate about a rotary shaft of the second contacting member, the guide member being configured to guide the recording medium having passed through the contact portion at which the first contacting member and the second contacting member contact each other, wherein the guide member is arranged in contact with a surface of the first contacting member and is configured to peel, from the surface, a recording medium stuck to the surface, and wherein the guide member is mounted directly to a columnar connecting member to which a rotating member is directly mounted, the rotating member additionally being directly mounted to the rotary shaft of the second contacting member.

2. The recording medium processing device according to claim 1, wherein the second contacting member includes a member configured to rotate around a rotational axis and, the guide member is mounted to the rotary shaft of the second contacting member.

3. The recording medium processing device according to claim 1, wherein the guide member is configured to be pressed against the surface of the first contacting member, and pressing of the guide member against the surface of the first contacting member is performed by using an own weight of the guide member.

4. A recording medium processing device comprising:

a pair of contacting members including a first contacting member and a second contacting member, the first contacting member and the second contacting member being configured to contact each other at a contact portion and to contact a recording medium passing through the contact portion, a contact position of the second contacting member on the first contacting member being configured to change in response to displacement of the second contacting member with respect to the first contacting member in a state of being held in a position for recording medium transportation; and a guide member mounted to the second contacting member, the guide member being configured to guide the recording medium having passed through the contact portion at which the first contacting member and the second contacting member contact each other, wherein the second contacting member includes a member configured to rotate around a rotational axis and, the guide member is mounted to a rotary shaft of the second contacting member further comprising a rotating member mounted to the rotary shaft of the second contacting member and configured to rotate around the rotary shaft, wherein the guide member is mounted to the rotating member, and mounted to the rotary shaft of the second contacting member via the rotating member.

5. The recording medium processing device according to claim 4, wherein the rotating member is mounted to a connecting member, and wherein a contacting member is mounted to the connecting member and configured to be pressed against the first contacting member, and wherein the rotating member is positioned with respect to the first contacting member via the contacting member.

6. The recording medium processing device according to claim 5, wherein the guide member is mounted to the rotating member such that a posture of the guide member with respect to the rotating member is changeable.

7. The recording medium processing device according to claim 4, wherein the guide member is mounted to the rotating member such that a posture of the guide member with respect to the rotating member is changeable.

8. An image forming apparatus comprising:

an image carrier having a surface on which a toner image is formed;

a transfer member that forms a transfer nip by coming into pressure contact with the image carrier and transfers the toner image formed on the image carrier to a recording medium;

a mounting portion that extends in an axial direction of the image carrier;

a guide member that is mounted to the mounting portion and guides a recording medium passing through the transfer nip, the guide member being configured to rotate about a rotary shaft of the transfer member; and a disk-shaped member that is mounted to the mounting portion, wherein the disk-shaped member contacts a portion of the image carrier on which no toner image is formed.

* * * * *